US007537405B2

(12) United States Patent
Breuer et al.

(10) Patent No.: US 7,537,405 B2
(45) Date of Patent: May 26, 2009

(54) PEN

(75) Inventors: Christian Breuer, Baden-Baden (DE); Jochen Luft, Nürnberg (DE); Peter Kämpf, Röttenbach (DE)

(73) Assignee: STABILO International GmbH, Heroldsberg (DE)

( * ) Notice: Subject to any disclaimer, the term of this patent is extended or adjusted under 35 U.S.C. 154(b) by 0 days.

(21) Appl. No.: 11/943,613

(22) Filed: Nov. 21, 2007

(65) Prior Publication Data

US 2008/0131188 A1 Jun. 5, 2008

(30) Foreign Application Priority Data

Nov. 30, 2006 (DE) ..... 20 2006 018 230 U

(51) Int. Cl.
*B43K 5/16* (2006.01)

(52) U.S. Cl. ..... 401/108; 401/107

(58) Field of Classification Search ..... 401/99, 401/107, 108
See application file for complete search history.

(56) References Cited

U.S. PATENT DOCUMENTS

| | | | | |
|---|---|---|---|---|
| 3,292,593 | A * | 12/1966 | Furuya | 401/107 |
| 4,367,965 | A * | 1/1983 | Speitel et al. | 401/60 |
| 4,759,640 | A | 7/1988 | Groner | |
| 5,022,775 | A | 6/1991 | Inoue et al. | |
| 6,033,141 | A | 3/2000 | Blaustein et al. | |
| 2004/0265035 | A1 | 12/2004 | Brand et al. | |
| 2006/0002757 | A1 | 1/2006 | Qiu | |
| 2006/0147248 | A1 | 7/2006 | Fukui et al. | |

FOREIGN PATENT DOCUMENTS

| | | |
|---|---|---|
| WO | 94/11204 A1 | 5/1994 |
| WO | 9819871 | 5/1998 |

* cited by examiner

*Primary Examiner*—David J Walczak
(74) *Attorney, Agent, or Firm*—Bachman & LaPointe, P.C.

(57) ABSTRACT

A pen comprising an applicator tip, a chamber for receiving the applicator tip in a rest position, wherein the chamber has a first through opening through which the applicator tip passes for moving from the rest position into an operative position, and a closure for closing the first through opening. In accordance with the invention the closure is on an outside of the chamber.

12 Claims, 3 Drawing Sheets

PEN

BACKGROUND OF THE INVENTION

The invention concerns a pen comprising an applicator tip, a chamber for receiving the applicator tip in a rest position, wherein the chamber has a first through opening through which the applicator tip passes for moving from the rest position into an operative position, and a closure for closing the first through opening.

Pens of the above-indicated kind are known, for example from US No 2004/0265035 A1. In that arrangement the closure which is in the fashion of a sliding door is disposed within the chamber. The sealing function results from a wedge-shaped configuration. More specifically, upon closure, the wedge-shaped part is drawn between two walls. Such a wedging configuration, for closure and even more for opening, requires the application of a considerable amount of force which has to be applied by pressure on the sliding door. In that situation buckling of the sliding door which is of a wall configuration is inevitable. It can also not be suppressed by the sliding door being guided in a gap. At least buckling cannot be prevented into the space where the sliding door has a slot for the applicator tip to pass therethrough.

U.S. Pat. No. 4,759,640 discloses a pen which, for closing the through opening of the chamber, has a pair of flaps (plastic material portions) which are formed integrally with the chamber. They are disposed within the chamber. So that the delicate writing tips do not touch the surfaces of those flaps upon activation/deactivation of the pen (by a pusher mechanism), complicated and expensive encapsulation of the ink reservoir used in the pen (it urges the flaps open) and precise geometrical matching of the portions which are in contact with each other are necessary.

In the pen in accordance with U.S. Pat. No. 6,033,141 the closure is in the form of an elastic, annular, inwardly curved, slotted seal which is disposed within the chamber. Activation/deactivation of the pen can be effected by a pusher mechanism or by a rotary mechanism, wherein the applicator tip is in direct contact with the seal when passing through the through opening because it has to press the seal open. Besides contamination of the seal that also suffers from the disadvantage that the applicator tip is mechanically stressed at each change in its operating condition, at the peripheral surface thereof. That is increasingly the case, the harder the seal. If the seal is made softer, there is the threat of losses of plasticisers in the seal material.

The object of the invention is to develop the pen known from US No 2004/0265035 A1 in such a way that adverse effects in relation to the closure when changing the operating condition thereof are avoided and nonetheless satisfactory sealing of the chamber in the rest condition is achieved.

In accordance with the invention the specified object is attained in that the closure is on an outside of the chamber.

In other words, in accordance with the invention, the chamber is sealed off from the outside and not from the inside, as is the case in US No 2004/0265035 A1. That design configuration has considerable mechanical advantages in terms of a change in the operating condition. In addition, in the case of an outwardly disposed closure, it is easier to ensure a reliable sealing function.

SUMMARY OF THE INVENTION

In accordance with the invention preferably the closure is adapted to be moved transversely with respect to a normal of the first through opening to close the first through opening. In other words it is pushed like a sliding door outside the chamber over the first through opening in order to close the first through opening.

In order to ensure the sealing function in respect of the closure, it is further preferred in accordance with the invention if the closure is biased in a closure position in the direction of closing the first through opening. In the case of a closure which is disposed externally in relation to the chamber, that biasing effect is mechanically substantially easier to implement than if the closure were within the chamber.

As a mechanically particularly simple implementation in accordance with the invention it is preferred if the closure at least portion-wise embraces a region of the chamber, that surrounds the first through opening, and the closure is subjected to a tensile loading for the biasing action.

In that case it can be provided in accordance with the invention that the closure has a first abutment which bears against a second abutment that is held immovably with respect to the chamber when the closure closes the first through opening. In that case, in the event of the closure being subjected to a tensile loading, the second abutment serves as a support means.

In accordance with a particularly preferred embodiment of the invention there is provided an elastic device for biasing the closure. Such a solution is superior to other biasing principles such as for example a wedging action or the like.

In accordance with a particularly preferred embodiment of the invention the elastic device is a spring, in particular a coil spring. That provides a mechanically particularly simple solution.

It is further preferably provided in accordance with the invention that the elastic device serves to move the applicator tip from the operative position into the rest position.

In other words, in accordance with that solution, the elastic device has two functions to perform, namely on the one hand biasing the closure and on the other hand moving the applicator tip from the operative position into the rest position. That reduces the number of components.

Preferably the elastic device is supported at one end against the chamber and at the other end against a support means. In particular supporting the elastic device at the chamber reduces the number of components because no additional components are required for supporting purposes.

In accordance with the invention the support means is further preferably a reservoir for a medium to be applied with the applicator tip.

In turn that solution again serves to reduce the number of components. When it is implemented, the reservoir moves together with the applicator tip on the one hand with respect to the chamber on the other hand, to change the operating condition. That avoids relative movement of the applicator tip with respect to the reservoir.

Further preferably the closure is coupled to the support means to produce the tensile stress. Accordingly a dual function is also attributed to the support means, namely on the one hand supporting the elastic device and on the other hand applying the tensile stress to the closure.

Preferably in accordance with the invention the chamber has a second through opening, through which extends a device for feeding to the applicator tip a medium to be applied. That solution is advantageous in particular when the chamber is to be kept small and accordingly is not to accommodate the entire feed means.

In that respect further preferably in accordance with the invention there is provided a seal for sealing off the feed device in the second through opening.

BRIEF DESCRIPTION OF THE DRAWINGS

The invention is described in greater detail hereinafter by means of a preferred embodiment with reference to the accompanying drawing in which.

DETAILED DESCRIPTION

Figure 1:
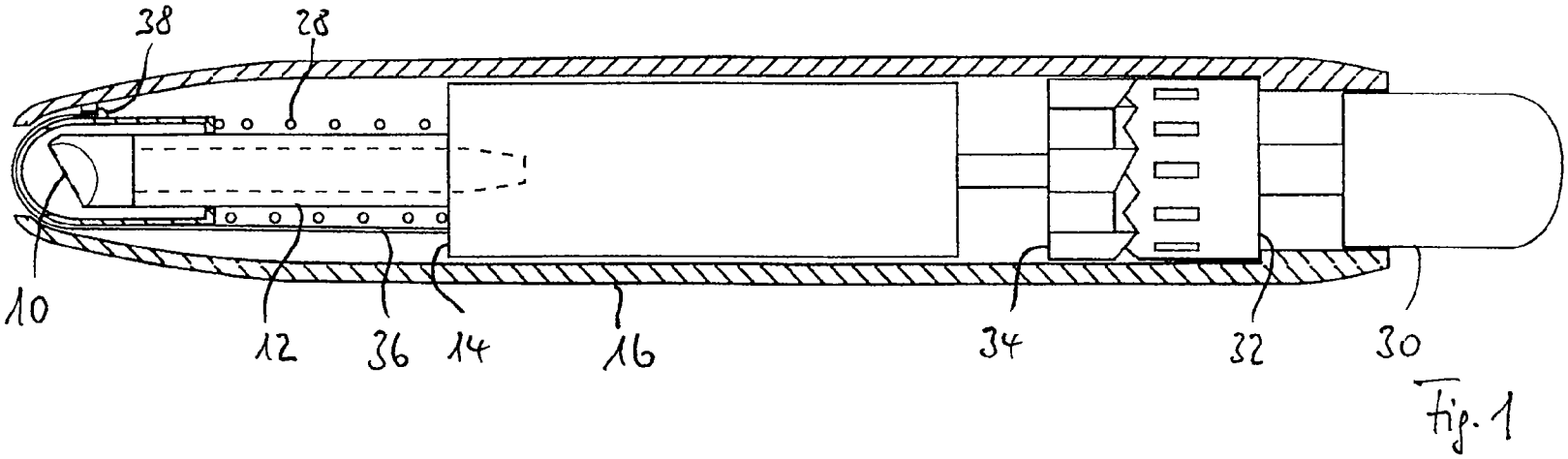
FIG. 1 is a diagrammatic view in longitudinal section of a pen in accordance with a preferred embodiment of the invention, more specifically in a rest position.

The pen illustrated in the drawing includes an applicator tip 10 which is communicated by way of an ink conductor 12 to a reservoir 14 for ink. The pen also includes a casing 16 in which a chamber 18 is immovably held. The chamber 18 has two through openings 20 and 22. The ink conductor 12 extends through the through opening 22. It is sealed off by means of a sealing ring 24. An abutment 26 which is also stationary with respect to the casing 16 is provided internally on the casing 16.

In contrast to the chamber 18 the reservoir 14 is held axially displaceably with respect to the casing 16. Disposed between the chamber 18 and the reservoir 14 is a spring 28 which is subjected to a compression loading, for which reason it urges the reservoir 14 towards the right in FIGS. 1 through 4 within the casing 16.

The pen further includes a push knob 30, a switching crown 32 and a switching star member 34. Those elements belong to a pusher mechanism which is widely used in the field of writing implements and therefore does not have to be described in greater detail.

Finally the pen illustrated in the drawing includes a closure diaphragm 36 which is fixed with its one end to the reservoir 14, in particular being injection molded thereto, while a further abutment 38 is provided at the other end thereof (the free end).

Figure 3:
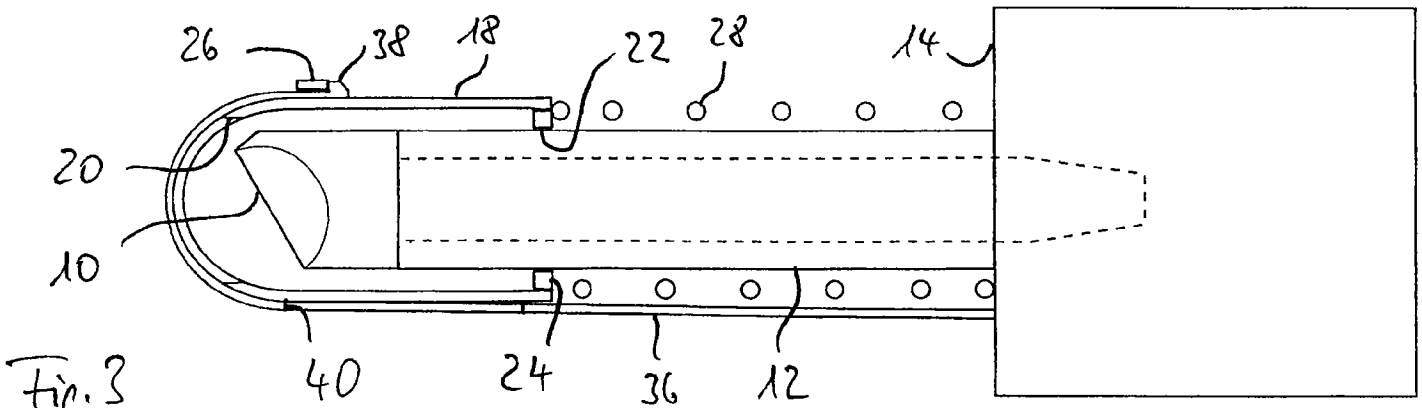

In the rest position shown in FIGS. 1 and 3 the applicator tip 10 is disposed within the chamber 18. In that position the closure diaphragm 36 closes the through opening 20 because it extends over that region of the chamber 18, in which the through opening 20 is provided. As the closure diaphragm 36 bears with its abutment 38 against the abutment 26, it cannot be pulled away by the return force of the spring 28 out of the region of the chamber, that surrounds the through opening 20. Rather, it is subjected to a tensile loading because the spring 28 presses against the reservoir 14 and accordingly the reservoir 14 pulls on the closure diaphragm 36.

In that position, that pressing force with which the closure diaphragm 36 is pressed on the outside on to the chamber 18 is inversely proportional to the radius of the outside contour of the chamber 18 around the through opening 20. Accordingly, the pressing force of the closure diaphragm 36 against the chamber 18 can be suitably adjusted by an appropriate choice of that radius, in particular in such a way that the closure diaphragm 36 sufficiently sealingly closes the chamber 18 or the through opening 20. As moreover the through opening 22 of the chamber 18 is closed by means of the sealing ring which bears sealingly against the ink conductor 12, the applicator tip 10 is reliably prevented from drying out.

Figure 2:
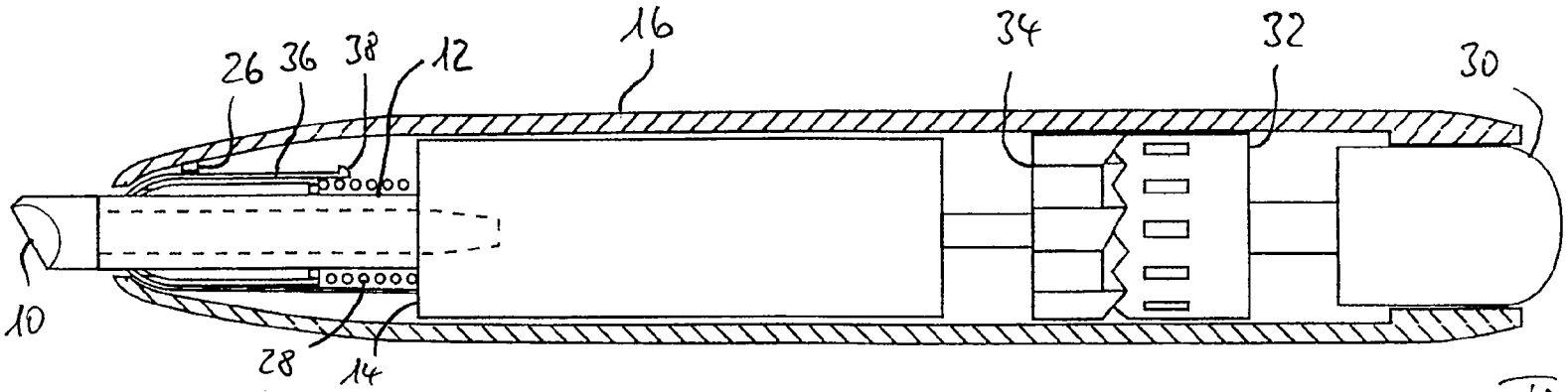
FIG. 2 shows the same view as FIG. 1 but in an operative position, FIG. 3 diagrammatically shows a partial view on an enlarged scale of FIG. 1, FIG. 4 diagrammatically shows a partial view on an enlarged scale of FIG. 2.
Figure 4:
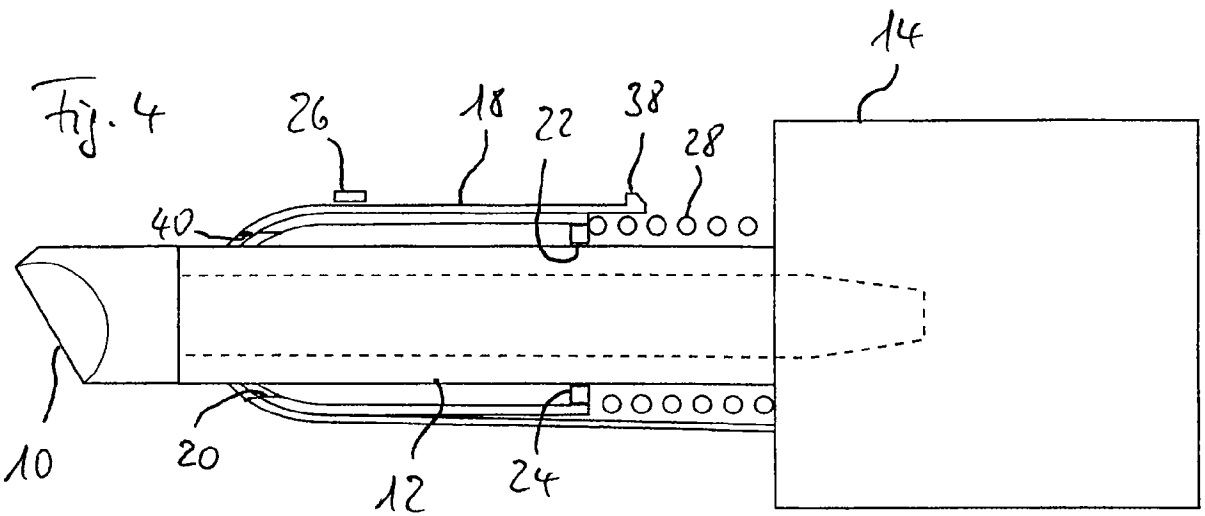
Figure 5:
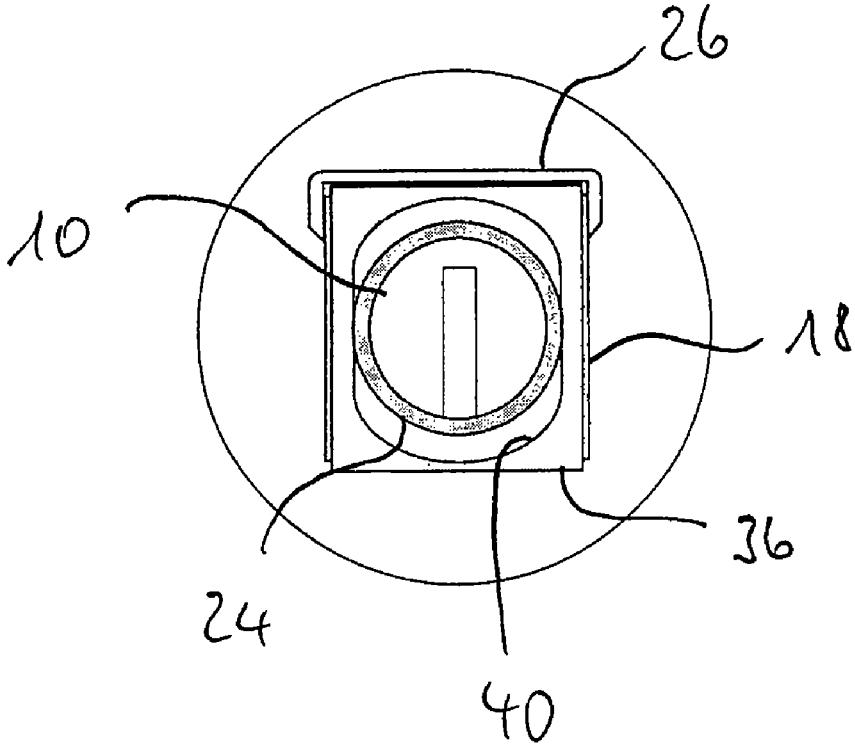
FIG. 5 shows an axial view of the pen in the operative position in accordance with FIGS. 2 and 4.

By pressure applied to the push knob 30 and axial displacement thereof with respect to the casing 16, the pen is moved out of the rest position shown in FIGS. 1 and 3 into the operative position shown in FIGS. 2, 4 and 5. In comparison with the rest position, the push knob 30, the switching crown 32, the switching star member 34 and the reservoir 14 together with the ink conductor 12 and the tip 10 have been displaced towards the left in FIGS. 1 through 4 with respect to the casing 16 and the chamber 18, in the operative position. As the closure diaphragm 36 is designed in the fashion of a 'sliding door' and therefore has sufficient flexibility for fitting snugly to the chamber 18 from the outside, but on the other hand has sufficient stiffness to be displaced overall by mere displacement of the reservoir 14 towards the left in FIGS. 1 through 4, the closure diaphragm 36 slides along the outside of the chamber 18 and in particular the abutment 38 is displaced towards the right in FIGS. 1 through 4 with respect to the abutment 26. For that purpose, the closure diaphragm 36 slides in a guide (not shown in the drawing) against the chamber 18 so that it can be displaced from the rest position into the operative position only by being pushed by means of the reservoir 14. As a result another region of the closure diaphragm 36 moves into that region of the chamber 18, in which the through opening 20 is formed. The closure diaphragm 36 also has a through opening 40 in that region which now at least partially coincides with the through opening 20.

In the operative position shown in FIGS. 2, 4 and 5 the ink conductor 12 extends through both the through opening 20 of the chamber 18 and also the through opening 40 of the closure diaphragm 36, for which reason the applicator tip 10 in that position is outside the chamber and also outside the casing 16.

If the push knob 30 is actuated in the operative position shown in FIGS. 2, 4 and 5, the spring 28 moves the pen back into the rest position shown in FIGS. 1 and 3 again.

That region of the outside wall of the chamber, which surrounds the through opening 20, can be made from a flexible material or covered therewith, for example in the form of a sealing ring, in order to improve the sealing function. That makes it possible to achieve an adequate sealing action even when a low level of tensile stress is involved.

The features of the invention disclosed in the foregoing description, the claims and the drawing can be essential both individually and also in any combinations for implementing the invention in its various embodiments.

The invention claimed is:

1. A pen comprising an applicator tip, a chamber for receiving the applicator tip in a rest position, wherein the chamber has a first through opening through which the applicator tip passes for moving from the rest position into an operative position, and a closure located outside of the chamber and including an elastic device for biasing the closure for closing the first through opening, wherein the elastic device serves to move the applicator tip from an operative position into a rest position.

2. A pen comprising an applicator tip, a chamber for receiving the applicator tip in a rest position, wherein the chamber has a first through opening through which the applicator tip passes for moving from the rest position into an operative position, and a closure located outside of the chamber and including an elastic device for biasing the closure for closing the first through opening, wherein the elastic device is supported at one end against the chamber and at the other end against a support means, and the support means is a reservoir for a medium to be applied with the applicator tip.

3. A pen as set forth in claim 2 wherein the elastic device serves to move the applicator tip from an operative position into a rest position.

4. A pen as set forth in claim 1 wherein the elastic device is supported at one end against the chamber and at the other end against a support means.

5. A pen as set forth in claim 4 wherein the support means is a reservoir for a medium to be applied with the applicator tip.

6. A pen as set forth in claim 4 or 2 wherein the closure is coupled to the support means to produce a tensile stress.

7. A pen as set forth in claim 1 or 2 wherein the closure is movable transversely with respect to a normal of the first through opening to close the first through opening.

8. A pen as set forth in claim 1 or 2 wherein the closure at least portion-wise embraces a region of the chamber, that surrounds the first through opening, and the closure is subjected to a tensile loading for the biasing action.

9. A pen as set forth in claim 1 or 2 wherein the closure has a first abutment which bears against a second abutment that is held immovably with respect to the chamber when the closure closes the first through opening.

10. A pen as set forth in claim 1 or 2 wherein the elastic device is a spring.

11. A pen as set forth in claim 1 or 2 wherein the chamber has a second through opening through which extends a device for feeding to the applicator tip a medium to be applied.

12. A pen as set forth in claim 11 including a seal for sealing off the feed device in the second through opening.

* * * * *